US006206723B1

(12) United States Patent
Kunishi

(10) Patent No.: US 6,206,723 B1
(45) Date of Patent: Mar. 27, 2001

(54) ELECTRICAL CONNECTOR FOR A FLAT CIRCUIT

(75) Inventor: Shinsuke Kunishi, Hadano (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/306,274

(22) Filed: May 6, 1999

(30) Foreign Application Priority Data

Jun. 19, 1998 (JP) ..... 10-189646

(51) Int. Cl.[7] ..... H01R 12/24
(52) U.S. Cl. ..... 439/495
(58) Field of Search ..... 439/495, 260, 439/267

(56) References Cited

U.S. PATENT DOCUMENTS 5,839,917 * 11/1998 Takahashi et al. ..... 439/495
5,842,883 * 12/1998 Igarashi et al. ..... 439/495
5,904,586 * 5/1999 Takayasu ..... 439/260

* cited by examiner

*Primary Examiner*—Lincoln Donovan
*Assistant Examiner*—Brian S. Webb
(74) *Attorney, Agent, or Firm*—Stephen Z. Weiss

(57) ABSTRACT

An electrical connector for a flat circuit includes a dielectric housing 1 defining a circuit-insertion slot 15. A plurality of terminals 24,28 are mounted on the housing and are spaced along the slot 15. The terminals have contact portions 9A,9B for engaging conductors spaced along the flat circuit. An actuator 3 is movably mounted on the housing for movement between an open position allowing insertion of the flat circuit into the slot 15 and a closed position biasing the circuit and its conductors against the contact portions 9A,9B of the terminals. Only some of the terminals comprise retention terminals 2A with portions for gripping the flat circuit and temporarily holding the circuit when the actuator is in its open position. Other of the terminals comprise non-retentive terminals 2B allowing substantially free insertion of the flat circuit into the slot 15.

14 Claims, 4 Drawing Sheets

ELECTRICAL CONNECTOR FOR A FLAT CIRCUIT

FIELD OF THE INVENTION

This invention generally relates to the art of electrical connectors and, particularly, to a connector for a flat circuit, such as a flat flexible circuit, a printed circuit board or the like.

BACKGROUND OF THE INVENTION

A typical electrical connector for a flat circuit includes an insulative or dielectric housing which defines a circuit-insertion slot. A plurality of terminals are mounted on the housing in generally parallel spaced relationship along the slot. Contact portions of the terminals are exposed in the slot for engaging conductors spaced along or transversely of the flat circuit. An actuator often is mounted on the housing for movement between an open position allowing insertion of the flat circuit into the slot and a closed position biasing the circuit and its conductors against the contact portions of the terminals.

Many electrical connectors for flat circuits as described above are designed for receiving the flat circuit with zero insertion force (ZIF). In other words, when the actuator is in its open position, the flat circuit can be inserted into the slot with zero forces. When the actuator is moved to its closed position, the circuit is gripped and the conductors of the circuit are biased against the contact portions of the terminals.

Unfortunately, problems often arise with ZIF-type electrical connectors because it often is impossible to temporarily hold the flat circuit while operating the actuator. In other words, if an operator holds the connector housing with one hand and inserts the flat circuit with another hand, the circuit has a tendency to move when the operator releases the circuit to actuate the actuator. As a result, the circuit may shift even slightly to cause incomplete or improper connections between the contact portions of the terminals and the conductors of the flat circuit. Attempts have been made to provide temporary holding means for the flat circuit, but such means either make the connector unduly complicated or the insertion forces are unacceptably high in order to achieve the desired temporary retention of the circuit. The present invention is directed to solving these problems and/or dilemmas.

SUMMARY OF THE INVENTION

An object, therefore, of the invention is to provide a new and improved electrical connector of the character described for a flat circuit, including a flat flexible circuit, a printed circuit board, a flexible printed circuit or the like.

In the exemplary embodiment of the invention, the connector includes a dielectric housing defining a circuit-insertion slot. A plurality of terminals are mounted on the housing and are spaced along the slot. The terminals have contact portions for engaging conductors spaced along the flat circuit. An actuator is movably mounted on the housing for movement between an open position allowing insertion of the flat circuit into the slot and a closed position biasing the circuit and its conductors against the contact portions of the terminals.

The invention contemplates that only some of the terminals comprise retention terminals with portions for gripping the flat circuit and temporarily holding the circuit when the actuator is in its open position. Other of the terminals comprise non-retentive terminals allowing substantially free insertion of the flat circuit into the slot.

As disclosed herein, each of the retention terminals includes substantially inflexible arms between which the flat circuit is inserted and gripped. At least one of the arms has the contact portion of the terminal thereon. Each of the non-retentive terminals includes a substantially flexible arm having the contact portion of the terminal thereon. In the preferred embodiment, the retention terminals and the non-retentive terminals alternate along the circuit-insertion slot. However, it is contemplated that the number of retention terminals be determined according to a desired insertion force on the flat circuit.

Finally, complementary interengaging pivot means are provided between the actuator and the housing for mounting the actuator on the housing with pivotal movement between the open and closed positions of the actuator. The retention terminals and the actuator include complementary engaging pivot portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
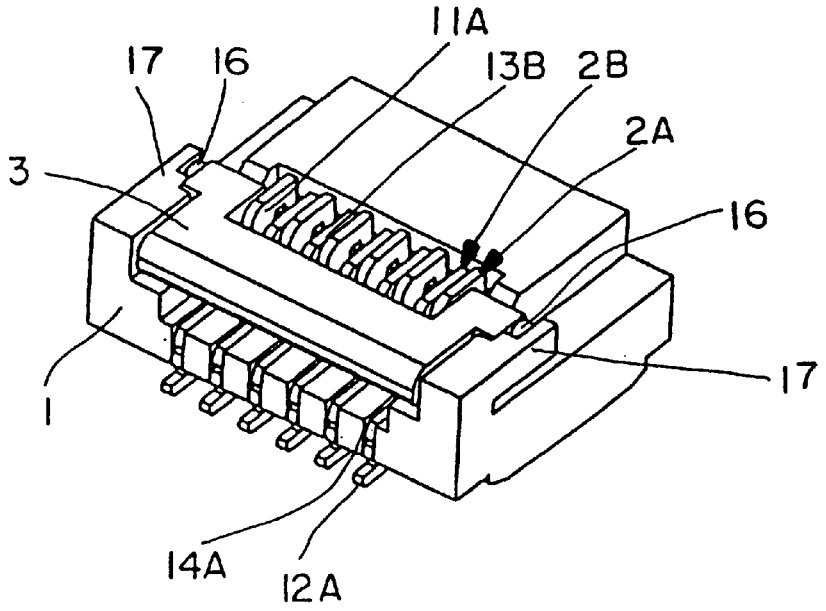
FIG. 1 is a perspective view of an electrical connector for a flat circuit incorporating the concepts of the invention.
Figure 2:
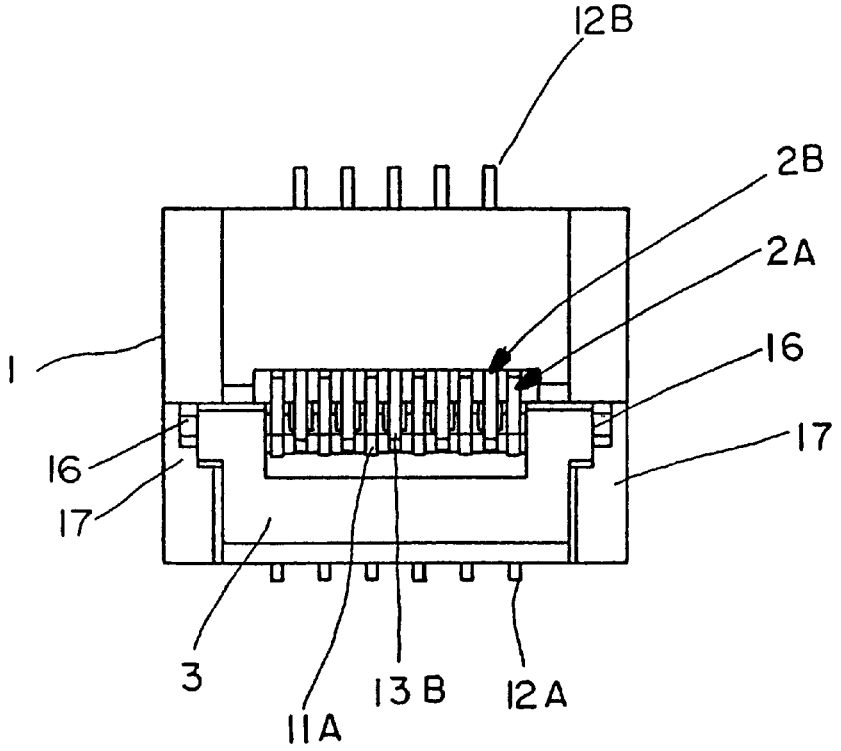
FIG. 2 is a top plan view of the connector.
Figure 3:
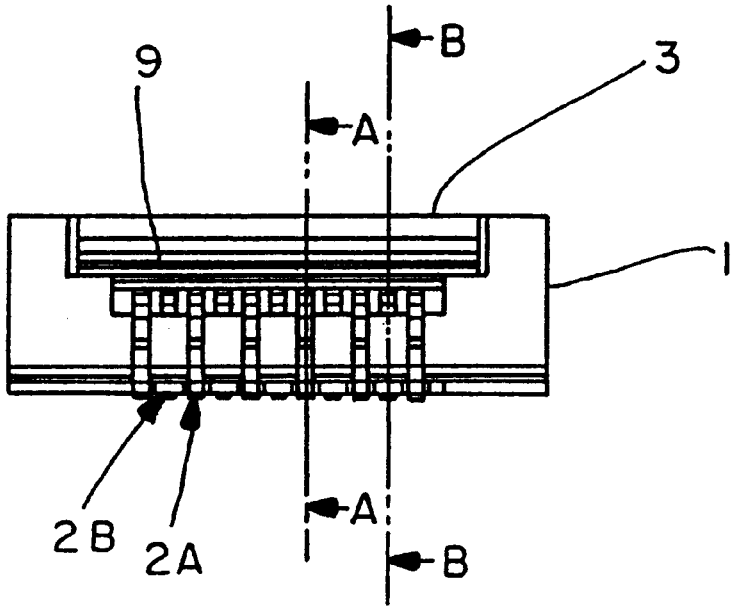
FIG. 3 is a front elevational view of the connector.
Figure 4:
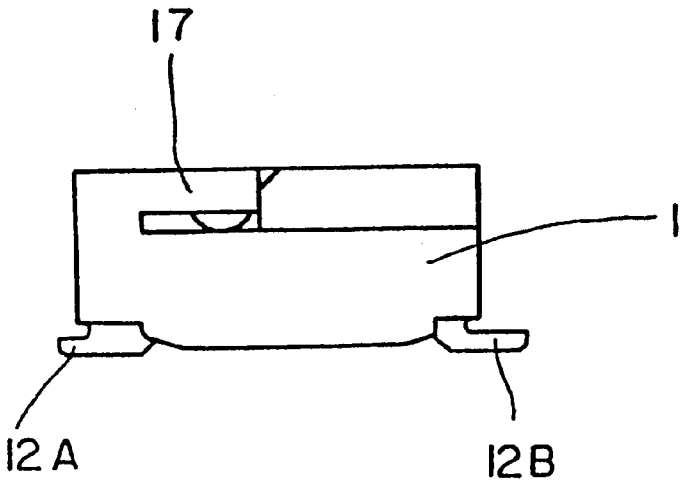
FIG. 4 is a side elevational view of the connector.

Referring to the drawings in greater detail, FIGS. 1–4 show the exterior of an electrical connector for a flat circuit, the connector including an insulative or dielectric housing 1 and an actuator 3 pivotally mounted on the housing for movement between an open position (FIGS. 7 and 8) and a closed position (FIGS. 1–6). In the open position, the actuator allows insertion of the flat circuit into the connector. In the closed position, the actuator biases the circuit against terminals mounted in the housing, as described hereinafter. Although the circuit is not shown in the drawings, the circuit typically will have generally parallel conductor strips running the length thereof and to a distal end of the circuit which is inserted into the connector.

Figure 5:
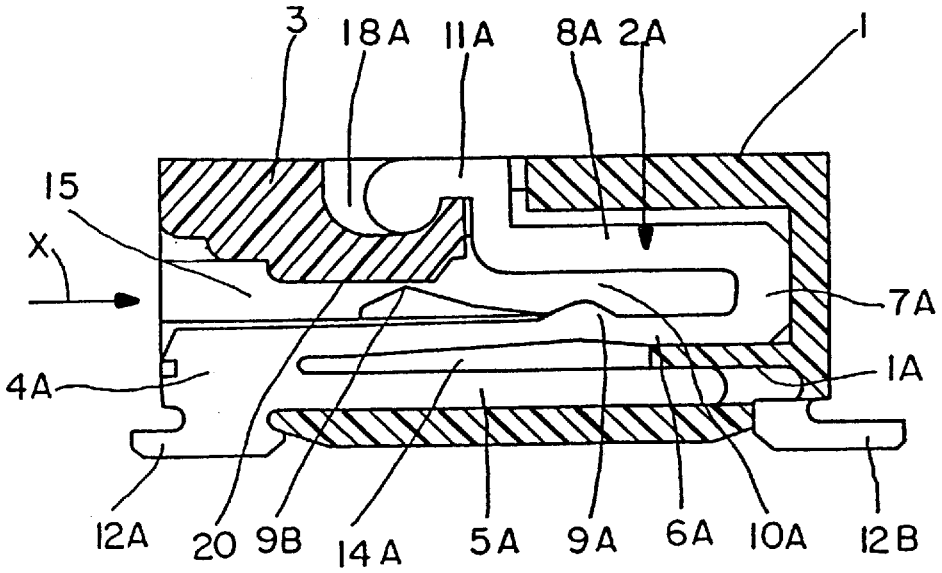
FIG. 5 is an enlarged vertical section taken generally along line A—A of FIG. 3.
Figure 6:
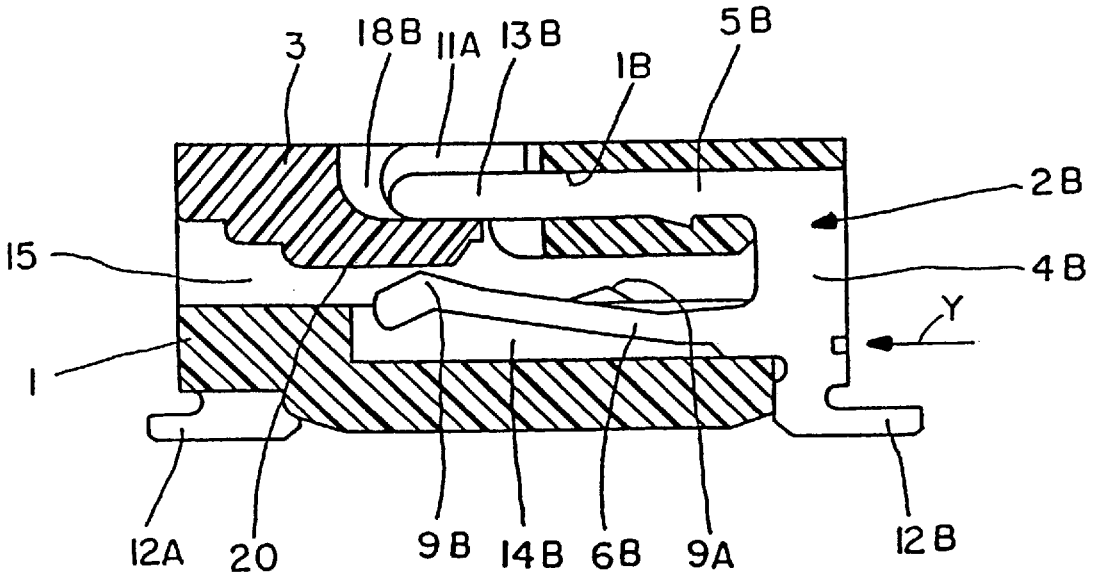
FIG. 6 is an enlarged vertical section taken generally along line B—B of FIG. 3.

Generally, the connector has two types of terminals mounted on housing 1 at spaced intervals along a circuit-insertion slot 15 (FIGS. 5 and 6). Specifically, FIGS. 5 and 7 best show one type of terminal which will be called a retention terminal, generally designated 2A. FIGS. 6 and 8 show a second type of terminal which will be called a non-retentive terminal, generally designated 2B. Retention terminals 2A and non-retentive terminals 2B alternate in spaced, generally parallel relationship along the length of circuit-insertion slot 15.

Figure 7:
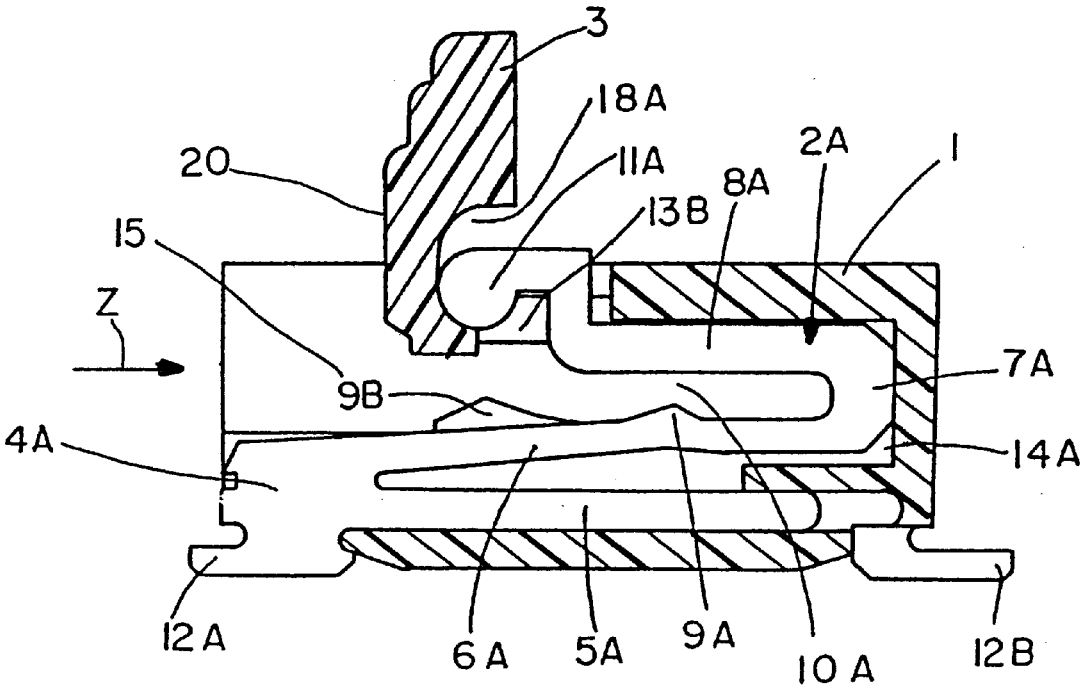
FIG. 7 is a view similar to that of FIG. 5, with the actuator in open position.
Figure 8:
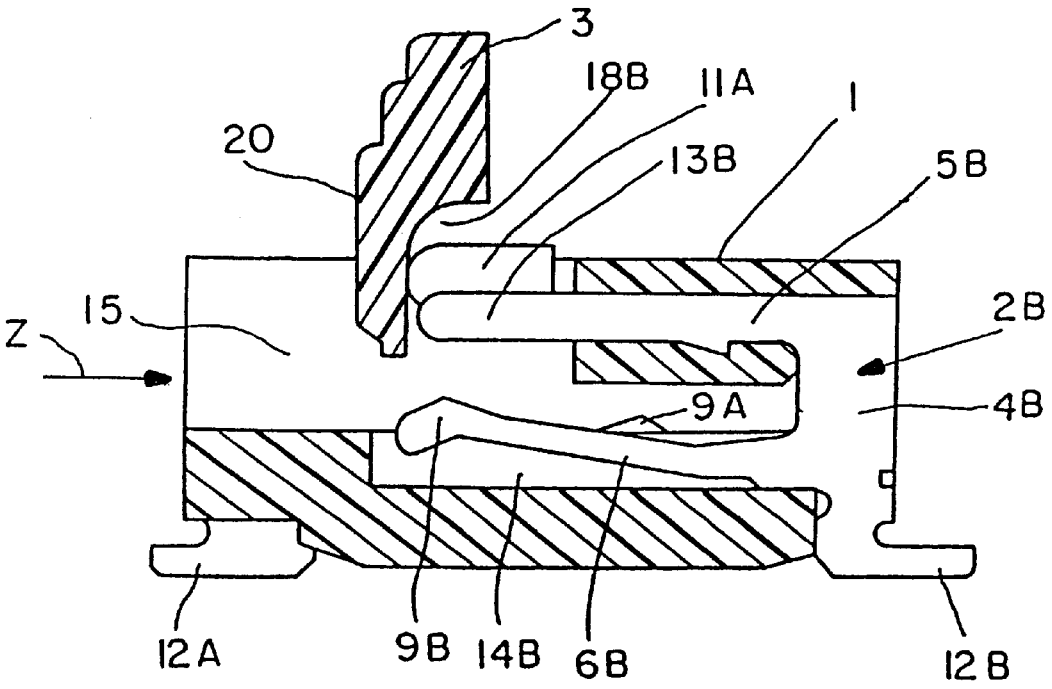
FIG. 8 is a view similar to that of FIG. 6, with the actuator in open position.

FIGS. 5 and 7 specifically show one of the retention terminals 2A. Each retention terminal is inserted into a passage 14A in housing 1 from the front thereof in the direction of arrow "X" (FIG. 5). Each retention terminal includes a body 4A from which a mounting arm 5A projects into a mounting slot 1A of the housing. An inflexible contact arm 6A extends from body 4A generally parallel to mounting arm 5A. The contact arm terminates in a vertical bridge portion 7A which leads to an inflexible gripping arm 8A which overlies and is spaced from contact arm 6A. A contact portion 9A projects upwardly from contact arm 6A and is exposed in slot 15, and a pivot portion 11A is formed at a distal end of gripping arm 8A. Gripping arm 8A and contact portion 9A define a closed circuit-gripping slot 10A between contact arm 6A and gripping arm 8A. Finally, a terminating portion 12A is disposed below body 4A outside housing 1 for termination to an appropriate circuit trace on a printed circuit board (not shown).

FIGS. 6 and 7 show one of the non-retentive terminals 2B. Each non-retentive terminal is inserted into a passage 14B in housing 1 in the direction of arrow "Y" (FIG. 6). Each non-retention terminal 2B includes a body 4B having a mounting arm 5B extending therefrom and into a mounting slot 1B in housing 1. A flexible contact arm 6B also projects from body 4B generally parallel to mounting arm 5B. The contact arm terminates in a contact portion 9B exposed in circuit-insertion slot 15. Like retention terminal 2A, non-retentive terminal 2B includes a terminating portion 12B for termination to an appropriate circuit trace on a printed circuit board (not shown). Finally, mounting arm 5B of the non-retentive terminal terminates in a pivot portion 12B.

Actuator 3 is pivotally mounted on housing 1 for pivotal movement between its open position (FIGS. 7 and 8) and its closed position (FIGS. 5 and 6). Specifically, a pair of pivot trunions 16 (FIGS. 1 and 2) project from opposite ends of actuator 3 into pivot holes in a pair of pivot arms 17 of housing 1. As seen in FIGS. 5–8, pivot portions 11A of retention terminals 2A and pivot portions 13B of non-retentive terminals 2B are interengaging within pivot sockets 18A and 18B, respectively, of the actuator.

In comparing retention terminal 2A in FIGS. 5 and 7 with non-retentive terminal 2B in FIGS. 6 and 8, it can be understood that with gripping slot 10A being a closed slot between contact arm 6A and gripping arm 8A, a positive gripping force can be applied to the flat circuit when the circuit is inserted between gripping arm 8A and contact portion 9A of contact arm 6A. Depending upon the thickness of the flat circuit, the distance between gripping arm 8A and contact portion 9A should be such as to apply a necessary gripping force on the flat circuit to temporarily hold the circuit within circuit-insertion slot 15.

On the other hand, it can be seen in FIGS. 6 and 8 (particularly FIG. 8) that the distance between contact portion 9B of flexible contact arm 6B and mounting arm 5B of non-retentive terminal 2B is significantly greater than circuit gripping slot 10A. This larger area, along with the flexibility of contact arm 6B, allows the flat circuit to be inserted into circuit-insertion slot 15 substantially free of any insertion forces.

From the foregoing understandings, it can further be understood that the amount of insertion forces on the flat circuit resulting in a particular amount of gripping forces can be determined either by the particular gripping forces applied by any single retention terminal 2A or the total number of retention terminals employed in the connector. In other words, although the retention terminals alternate with non-retentive terminals 2B in the connector as shown herein, the number of retention terminals 2A can be varied to vary the insertion forces and the resulting gripping forces.

In operation of the connector herein, actuator 3 is pivoted upwardly to its open position as shown in FIGS. 7 and 8. The flat circuit then is inserted into circuit-insertion slot 15 in the direction of arrows "Z". The tip or front edge of the circuit passes over contact portions 9B at the distal ends of contact arms 6B of non-retentive terminals 2B substantially free of any insertion forces. The front edge of the flat circuit then engages contact portions 9A of contact arms 6A of retention terminals 2A, and the flat circuit becomes gripped between contact portions 9A and gripping arms 8A of the retention terminals. The flat circuit is inserted fully into the connector until its front edge abuts against bridge portions 7A of the retention terminals. The operator then can release the flat circuit whereupon the flat circuit is temporarily gripped by the retention terminals, and the operator easily can then move actuator 3 to its closed position shown in FIGS. 5 and 6 where lower surface 20 of actuator 3 contacts the flat circuit to fully grasp the flat circuit and bias the conductors of the circuit against contact portions 9A and 9B of terminals 2A and 2B, respectively.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for a flat circuit, comprising:

a dielectric housing defining a circuit-insertion slot with an opening in one face of the housing, the slot having an upper and a lower ledge at an end of the slot opposite the face with the opening;

a plurality of terminals mounted on the housing and spaced along the slot, the terminals having contact portions for engaging conductors spaced along the flat circuit;

an actuator movably mounted on the housing for movement between an open position allowing insertion of the flat circuit into the slot and a closed position biasing the circuit and its conductors against the contact portions of the terminals;

only some of said terminals comprising retention terminals with portions for gripping the flat circuit and temporarily holding the circuit when the actuator is in its open position;

each retention terminal including a contact arm and an inflexible gripping arm defining a closed circuit gripping slot there between, the contact and gripping arms joined at one end by a bight, a mounting arm held in the housing, the contact arm extending from a portion of the mounting arm adjacent the face of the housing with the opening, the contact arm terminating at the bight and located so that the a portion of the contact arm adjacent the bight being able to contact the lower ledge when the actuator is in the closed position, a contact portion on the contact arm located between the portion of the contact arm adapted to contact the lower ledge and the mounting arm, an inflexible gripping arm extending from the bight overlying and being spaced from the contact arm and located so that a portion of the gripping arm being able to contact the upper ledge when the actuator is in the open position, and a pivot portion formed at a distal end of the gripping arm; and other of said terminals comprising non-retentive terminals allowing substantially free insertion of the flat circuit into the slot.

2. The electrical connector of claim 1 wherein each of said retention terminals includes substantially inflexible arms between which the flat circuit is inserted and gripped.

3. The electrical connector of claim 2 wherein at least one of said arms has the contact portion of the terminal thereon.

4. The electrical connector of claim 1 wherein each of said non-retentive terminals includes a substantially flexible arm having the contact portion of the terminal thereon.

5. The electrical connector of claim 1 wherein said retention terminals and said non-retentive terminals alternate along the circuit-insertion slot.

6. The electrical connector of claim 1, including complementary interengaging pivot means between the actuator and the housing for mounting the actuator on the housing with pivotal movement between said open and closed positions.

7. The electrical connector of claim 6 wherein said actuator and said retention terminals include complementarily engaging pivot portions.

8. An electrical connector for a flat circuit, comprising:

a dielectric housing defining a circuit-insertion slot with an opening in one face of the housing, the slot having an upper and a lower ledge at an end of the slot opposite the face with the opening;

a plurality of terminals mounted on the housing and spaced along the slot, the terminals having contact portions for engaging conductors spaced along the flat circuit;

an actuator movably mounted on the housing for movement between an open position allowing insertion of the flat circuit into the slot and a closed position biasing the circuit and its conductors against the contact portions of the terminals;

only some of said terminals comprising retention terminals including substantially inflexible arms between which the flat circuit is inserted and gripped to temporarily hold the circuit when the actuator is in its open position, at least one of the arms of each retention terminal having the contact portion of the terminal thereon;

each retention terminal including a contact arm and an inflexible gripping arm defining a closed circuit gripping slot there between, the contact and gripping arms joined at one end by a bight, a mounting arm held in the housing, the contact arm extending from a portion of the mounting arm adjacent the face of the housing with the opening, the contact arm terminating at the bight and located so that the a portion of the contact arm adjacent the bight being able to contact the lower ledge when the actuator is in the closed position, a contact portion on the contact arm located between the portion of the contact arm adapted to contact the lower ledge and the mounting arm, an inflexible gripping arm extending from the bight overlying and being spaced from the contact arm and located so that a portion of the gripping arm being able to contact the upper ledge when the actuator is in the open position, and a pivot portion formed at a distal end of the gripping arm; and other of said terminals comprising non-retentive terminals including substantially flexible arms having the contact portions of the terminals thereof and allowing substantially free insertion of the flat circuit into the slot.

9. The electrical connector of claim 8 wherein said retention terminals and said non-retentive terminals alternate along the circuit-insertion slot.

10. The electrical connector of claim 8, including complementary interengaging pivot means between the actuator and the housing for mounting the actuator on the housing with pivotal movement between said open and closed positions.

11. The electrical connector of claim 10 wherein said actuator and said retention terminals include complementarily engaging pivot portions.

12. An electrical connector for a flat circuit, comprising:

a dielectric housing defining a circuit-insertion slot with an opening in one face of the housing, the slot having an upper and a lower ledge at an end of the slot opposite the face with the opening;

a plurality of terminals mounted on the housing and spaced along the slot, the terminals having contact portions for engaging conductors spaced along the flat circuit;

an actuator pivotally mounted on the housing for pivotal movement between an open position allowing insertion of the flat circuit into the slot and a closed position biasing the circuit and its conductors against the contact portions of the terminals;

only some of said terminals comprising retention terminals with substantially inflexible arms between which the flat circuit is inserted and gripped to temporarily hold the circuit when the actuator is in its open position, one of said arms of each terminal having the contact portion of the terminal thereon and the other arm of each terminal having a pivot portion engageable with a pivot portion of the actuator;

each retention terminal including a contact arm and an inflexible gripping arm defining a closed circuit gripping slot there between, the contact and gripping arms joined at one end by a bight, a mounting arm held in the housing, the contact arm extending from a portion of the mounting arm adjacent the face of the housing with the opening, the contact arm terminating at the bight and located so that the a portion of the contact arm adjacent the bight being able to contact the lower ledge when the actuator is in the closed position, a contact portion on the contact arm located between the portion of the contact arm adapted to contact the lower ledge and the mounting arm, an inflexible gripping arm extending from the bight overlying and being spaced from the contact arm and located so that a portion of the gripping arm being able to contact the upper ledge when the actuator is in the open position, and a pivot portion formed at a distal end of the gripping arm; and other of said terminals comprising non-retentive terminals allowing substantially free insertion of the flat circuit into the slot.

13. The electrical connector of claim 12 wherein each of said non-retentive terminals includes a substantially flexible arm having the contact portion of the terminal thereon.

14. The electrical connector of claim 12 wherein said retention terminals and said non-retentive terminals alternate along the circuit-insertion slot.

* * * * *